United States Patent [19]

Okita et al.

[11] Patent Number: 5,040,494

[45] Date of Patent: Aug. 20, 1991

[54] COOLING APPARATUS FOR V-TYPE INTERNAL COMBUSTION ENGINE

[75] Inventors: Junichi Okita, Iwakuni; Ryoji Abe; Masakazu Tokuyama, both of Hiroshima, all of Japan

[73] Assignee: Mazda Motor Corporation, Hiroshima, Japan

[21] Appl. No.: 562,338

[22] Filed: Aug. 3, 1990

[30] Foreign Application Priority Data

Aug. 4, 1989 [JP] Japan ..... 1-92328[U]

[51] Int. Cl.[5] ..... F01P 5/10

[52] U.S. Cl. ..... 123/41.46; 123/41.44

[58] Field of Search ..... 123/41.44, 41.46, 41.47

[56] References Cited

U.S. PATENT DOCUMENTS 2,852,009 9/1958 Turlay ..... 123/41.47

FOREIGN PATENT DOCUMENTS 60-153818 10/1985 Japan .

60-195325 10/1985 Japan ..... 123/41.44

*Primary Examiner*—Noah P. Kamen

*Attorney, Agent, or Firm*—Fleit, Jacobson, Cohn, Price, Holman & Stern

[57] ABSTRACT

A cooling apparatus for a V-type internal combustion engine has a water pump disposed at a central portion of a front end surface of an engine cylinder block. A cooling water inlet passage, provided between the radiator and water pump for introducing cooling water into the water pump, includes an external pipe extending along the front end of the engine cylinder block and turning into a V-shaped space defined by and between elongated first and second cylinder banks set at an angle relative to each other and an internal passageway formed in the cylinder block. The internal passageway has one end communicated with the water pump and its other end opening to the bottom of the V-shaped space and connected to the external pipe.

6 Claims, 2 Drawing Sheets

COOLING APPARATUS FOR V-TYPE INTERNAL COMBUSTION ENGINE

FIELD OF THE INVENTION

The present invention relates to a cooling apparatus for a V-type internal combustion engine, and more particularly to a cooling apparatus having a novel layout or arrangement of a cooling water inlet pipe.

BACKGROUND OF THE INVENTION

A typical V-type internal combustion engine has left and right cylinder banks arranged so as to define a V-shaped space therebetween. A row of cylinders in one of the cylinder banks is generally offset in a forward direction with respect to the vehicle in which it is mounted relative to a row of cylinders in the other cylinder bank. A cooling apparatus provided in such a V-type internal combustion engine typically has a water pump located at a central portion of the front end surface of a cylinder block and a cooling water passageway for introducing cooling water into the water pump. The passageway is typically formed in what is termed a "dead space" of the other cylinder between the front end of the engine and the foremost cylinder. An upstream part of the passageway usually extends to the side of the other cylinder block remote from the V-shaped space, and a downstream part thereof extends to the front end of the other cylinder block. The cooling water passageway is connected, at its upstream end, to a thermostat installed in the cooling system and, at its downstream end, to a pump chamber of the water pump. Such an arrangement, i.e., one having a cooling water passageway formed in the dead space with a row of cylinders in one cylinder bank offset forward with respect to the vehicle relative to a row of cylinders in the other cylinder bank, is known from, for instance, Japanese Utility Model Application No. 59-41105, entitled "Cooling Apparatus For V-Type Engine," filed on Mar. 22, 1984, and laid open as Japanese Unexamined Utility Model Publication No. 60-153818 on Oct. 14, 1985.

The passageway formed in the dead space of a cylinder bank as described in the above publication necessarily has a sharply curved downstream part opening to the front end of the cylinder bank. This sharply curved passageway part is apt to cause an increase in friction drag on the cooling water. Typically, in the case of engines designed to have rows of cylinders offset by a distance which is as short as possible for compactness, the passageway formed in the dead space, which is generally small in volume, is curved more sharply at its downstream part. Therefore, a great increase in friction drag on the cooling water is generated. This results in an insufficient cooling water supply to the water pump during a high speed operation of the engine.

SUMMARY OF THE INVENTION

It is, therefore, a primary object of the present invention to provide a cooling apparatus for a V-type internal combustion engine having a compact cooling water passageway arrangement which allows cooling water to flow with a decreased friction drag therein so that a sufficient amount of cooling water can flow therein during a high speed operation of the engine.

The object of the present invention is accomplished by a cooling apparatus for a V-type internal combustion engine having a cylinder block, and first and second cylinder heads mounted on the cylinder block so as to provide elongated first and second banks set at an angle to each other to define a V-shaped space therebetween. The engine is provided with a water pump, having an axis of rotation extending through a central portion of the front end surface of the cylinder block and below the V-shaped space, secured to the front end surface of the cylinder block, and a fan disposed coaxially with the axis of rotation of the water pump in front of the water pump and with a space between the fan and the front end surface of the cylinder block. A cooling water inlet passage for introducing cooling water into the water pump from a radiator has an external pipe having an inlet pipe portion extending in the space between the fan and the front end surface of the cylinder block toward above the water pump, or to a point adjacent to a bottom of the V-shaped space, and a connecting pipe portion extending from the inlet pipe portion into the V-shaped space. The cooling water inlet passage further has an internal pipe provided as a passageway formed in the cylinder block with one end opening to the V-shaped space and connected to the connecting pipe portion and another end connected to a pump chamber of the water pump secured to the cylinder block.

BRIEF DESCRIPTION OF THE DRAWINGS

The above and other objects and features of the present invention will be apparent from the following description of a preferred embodiment thereof when considered in conjunction with the accompanying drawings, in which.

DESCRIPTION OF THE PREFERRED EMBODIMENT

Figure 2:
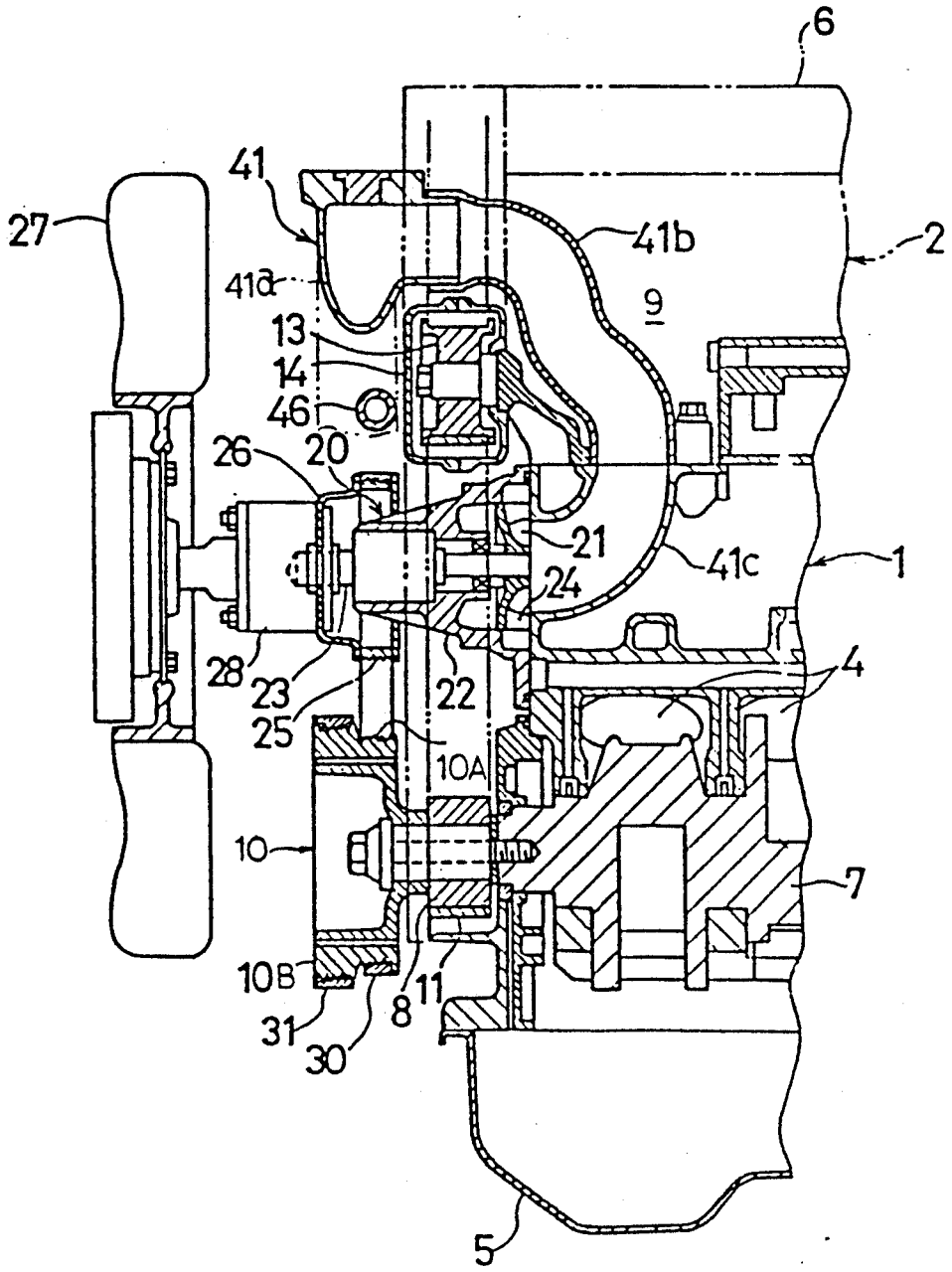
FIG. 2 is a cross-sectional view of the engine shown in FIG. 1 as it appears along section line II—II.

Referring to the drawings in detail, an engine body E of a V-type engine, for instance a V-6 engine, having a cooling apparatus in accordance with a preferred embodiment of the present invention is shown. The engine body E consists of left and right cylinder banks 3*a* and 3*b* arranged in a V-formation with a predetermined relative angle therebetween. For example, a relative angle of 60 degrees between the cylinder banks may be provided so as to define a V-shaped space 9 therebetween. What are termed the No. 1, No. 3 and No. 5 cylinders 4 are formed and arranged in a straight row in the left cylinder bank 3*a*, and what are termed the No. 2, No. 4 and No. 6 cylinders 4 are formed and arranged in a straight row in the right cylinder bank 3*b*. The No. 1 cylinder, the No. 6 cylinder, the No. 3 cylinder, the No. 4 cylinder, the No. 5 cylinder and, finally, the No. 2 cylinder are fired in order. That is, the cylinders 4 divided into two groups, and the cylinders in each group are disposed in one and the same cylinder bank 3*a* or 3*b*, respectively, so that adjoining cylinders in each cylinder bank 3*a* or 3*b* do not fire sequentially, i.e., one after another. The left and right cylinder banks 3*a* and 3*b* are offset with respect to the vehicle in which they are mounted (toward the left in FIG. 2) relative to each other, so that the row of the cylinders 4 in the left cylinder bank 3*a* is offset forward with respect the vehicle relative to the row of the cylinders 4 in the right cylinder bank 3*b*.

The engine E has a cylinder block 1 provided with cylinder bores in which pistons (not shown) can slide and a pair of cylinder heads 2 which are mounted on the cylinder block 1, and provides for the left and right cylinder banks 3*a* and 3*b*, respectively. A cylinder head cover 6 is provided to cover the upper portion of each cylinder head 2. The engine E further has an oil pan 5 attached to the bottom of the cylinder block 1. A crankshaft 7 is supported by the cylinder block 1 for rotation. In a well known manner, the crankshaft 7 is connected to each piston by a connecting rod. Each connecting rod is of a well known type.

The crankshaft 7 projects from the cylinder block 1. A crankshaft sprocket or pulley 8 is coaxially fixed on the part of the crankshaft 7 projecting from the cylinder block 1. The pulley 8 is connected or coupled to camshaft pulleys 12 by a timing chain or toothed timing belt 11 which transmits the engine output to drive the camshaft pulleys 12 so as to open and close intake and exhaust ports at a predetermined timing by intake and exhaust valves, respectively. A front engine cover 14 partially covers the belt 11 and the camshaft pulleys 12. Belt 11 and pulleys 8 and 12 together constitute an overhead camshaft driving mechanism. A distributor 15 is coaxially fixed on the end of the part of each camshaft 12A projecting outside the front engine cover 14. An integral pulley unit 10, formed with pulleys 10A and 10B of different diameters, is disposed outside the front engine cover 14 and is coaxially fixed on the end of that part of the crankshaft 7 projecting from the cylinder block 1. These pulleys 10A and 10B are connected or coupled to pulleys 25, 33, 35 and 37 by belts 30 and 31 so as to transmit the engine output to drive various elements which will be described in detail later. The belts 11, 30 and 31 are tensioned by idle pulleys 13 (see FIG. 2), 38 and 39 (see FIG. 1), respectively.

A water pump 20, which may be of any well known type, is disposed in front of the front end of the cylinder block 1. The water pump 20 has a pump housing 22 attached to the front end surface of the cylinder block 1 so as to form a pump chamber 21 therebetween. A rotary shaft 23 has an axis of rotation passing through a center of the cylinder block 1 and is supported by the pump housing 22 for rotation. The rotary shaft 23 is coaxially fixed, at its inner end, to an impeller 24 located within the pump chamber 21 and, at its outer end, to a cylindrical supporting bracket 26 by which the pump pulley 25 is firmly held. The rotary shaft 23 is further coaxially fixed to a fan 27 by a connecting member 28. The pump pulley 25 is connected or coupled to the pulley 10A of the pulley unit 10, fixed to the crankshaft 7, by a belt 30. Belt 30 transmits the engine output to drive the water pump 20 and the fan 27.

Disposed in front of the front end surface of the cylinder block 1 are an air conditioning compressor 32, an alternator 34 and a power steering pump 36. The air conditioning compressor 32, disposed in a space formed between the right cylinder bank 3*b* and the cylinder block 1 below the right cylinder bank 3*b*, has a pulley 33 connected or coupled to the pulley 10A of the pulley unit 10 by the belt 30 which transmits the engine output to drive the air conditioning compressor 32. The alternator 34 and the power steering pump 36, disposed in a space formed between the left cylinder bank 3*a* and the cylinder block 1 below the left cylinder bank 3*a*, have pulleys 35 and 37, respectively. Pulleys 35 and 37 are connected or coupled to the pulley 10B of the pulley unit 10 by a belt 31, which transmits the engine output to drive the alternator 34 and the power steering pump 36.

Cooling water is introduced into the water pump 20 through cooling water inlet passage means 41 and discharged from the cylinder block 1 through a cooling water outlet passage means 45. The cooling water inlet passage means 41 comprises an external passage portion constituted by an upstream and an intermediate or connecting pipe part 41*a* and 41*b*, respectively, and an internal passage portion formed in the cylinder block 1 and constituted by a downstream pipe part 41*c* formed as a quarter-circular internal passageway, i.e., one which bends through approximately 90°. These pipe parts 41*a* to 41*c* are connected as an integral passageway. That is, the upstream pipe part 41*a* (see FIG. 1) extends upwards from a thermostat valve 42, disposed in the space formed between the right cylinder bank 3*b* and the cylinder block 1 below the right cylinder bank 3*b*, to a point located above the water pump 20 and adjacent a bottom of the V-shaped space 9 formed between the left and right cylinder banks 3*a* and 3*b*, passing in a front space between the front engine cover 14 and the fan 27. The connecting pipe part 41*b* (see FIG. 2) turns backward and extends in the V-shaped space 9 from the point located above the water pump to which part 41*a* extends to the bottom of the V-shaped space 9. Finally, the downstream pipe part 41*c* (see FIG. 2), formed as a quarter-circular internal passage in the cylinder block 1 between the left and right cylinder banks 3*a* and 3*b*, extends forward to the front end surface of the cylinder block 1 so as to communicate with the pump chamber 21 of the water pump 20.

Figure 1:
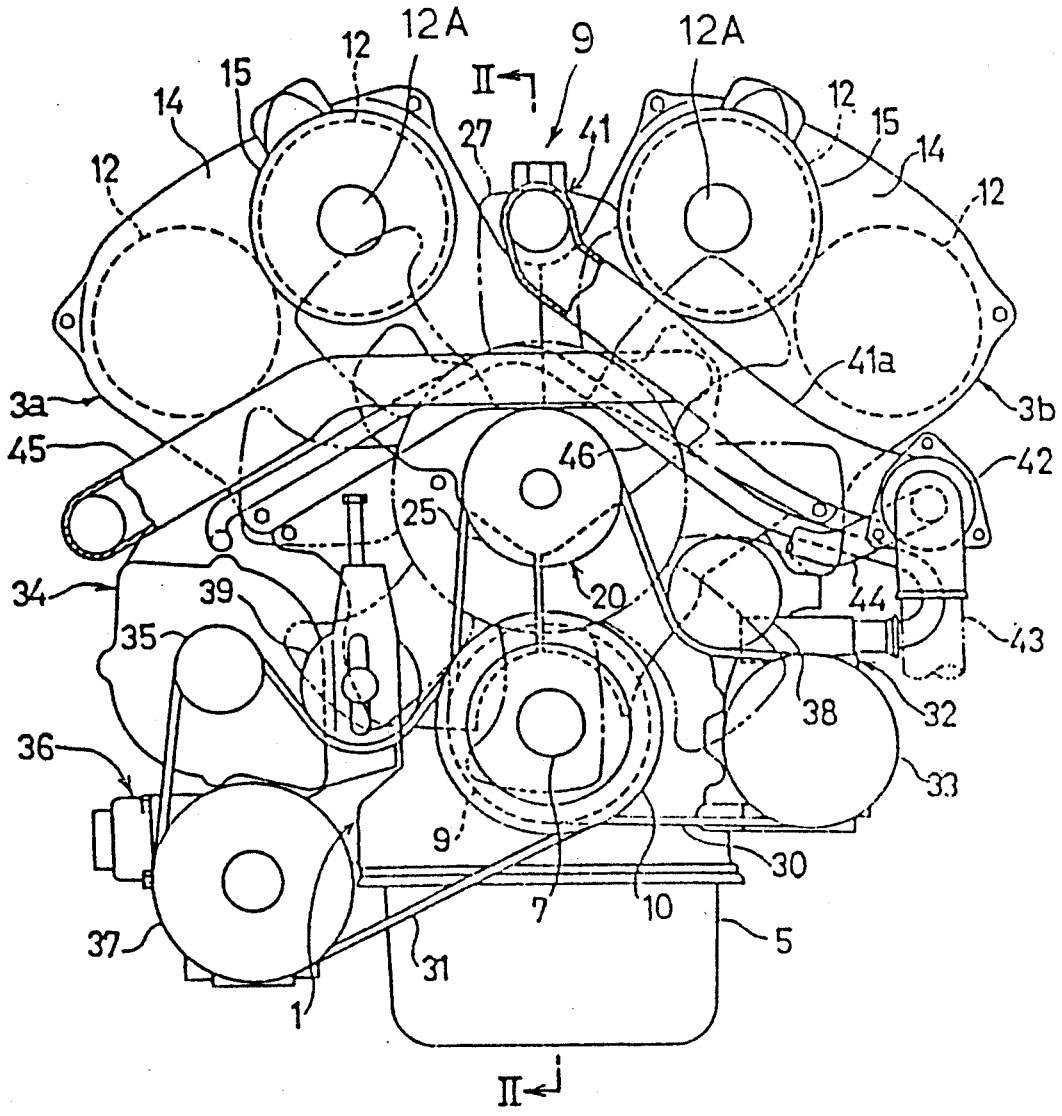
FIG. 1 is a front view of a V-type internal combustion engine with a cooling apparatus in accordance with a preferred embodiment of the present invention.

As is seen in FIG. 1, the discharge or outlet pipe 45 extends from the right cylinder bank 3*b* toward a space on a side opposite to the side where the thermostat valve 42 is disposed with respect to the cylinder block 1, passing in the space between the front engine cover 14 and the fan 27. The outlet pipe 45 is connected to an upper radiator hose (not shown) so as to return the coolant water into a radiator (not shown) disposed in front of the fan 27. Also, as shown in FIG. 1, a pressure pipe 46 of the air conditioning system extends from one side of the cylinder block 1 from the compressor pump 32 to the opposite side of the block, passing in the space between the front engine cover 14 and the fan 27.

According to the layout of the inlet and outlet pipes 41 and 45 described above, the external pipe section is arranged to extend in spaces formed between elements necessary to form the engine and its assisting apparatus, such as the space between the front engine cover 14 and the fan 27 or the space between the banks 3*a* and 3*b*. Also, the downstream pipe section communicating with the water pump 20 is formed as an internal passage in the cylinder block 1. This allows installation of the cooling system without requiring much space not only in but also around the engine block 1. Furthermore, since the downstream pipe part 41*c* extends between the left and right cylinder banks 3*a* and 3*b* of the cylinder block 1, the inlet pipe 41 does not interfere with any one of the cylinders 4 of the left and right cylinder banks 3*a* and 3*b*, even though the inlet pipe 41 curves through a quarter-circle. Moreover, since the internal downstream pipe part 41*c* smoothly curves before it opens to the water pump 20, the inlet pipe forming the passage means 41 introduces the coolant water into the water pump 20 with a reduced water flow resistance, so as to permit an increased flow rate of the coolant water, in particular when the water pump 20 rotates at a high speed. The layout of the cooling system described above, including the water pump 20 and its associated inlet and outlet pipes 41 and 45, in combination with the arrangement of the engine assisting or engine assisted apparatus, such as the air conditioning compressor 32, the alternator 34 and the power steering pump 36, disposed in the spaces below the left and right cylinder banks 3*a* and 3*b*, makes efficient use of spaces which heretofore have generally not been used and which have been left as dead space in V-type engines. Moreover, in the pipe layout in the preferred embodiment of the present invention described above, since the pipe 46, extending from the air conditioning compressor 32, is located between the front engine cover 14 and the fan 27, the fan can circulate air, cooled by the pipe 46 when the air conditioning compressor 32 is in action, around and toward the front engine cover 14, so as to cool the space between the front engine cover 14 and the fan 27. This cooling action helps to prevent the timing belt 11 from being degraded by heat.

It is to be understood that although the invention has been described in detail with respect to a preferred embodiment thereof, nevertheless, various other embodiments and variants are possible which are within the spirit and scope of the present invention, and such embodiments and variants are intended to be covered by the following claims.

What is claimed is:

1. A cooling apparatus for a V-type internal combustion engine having a cylinder block and first and second cylinder heads mounted on the cylinder block so as to provide elongated first and second cylinder banks set at an angle to each other to define a V-shaped space therebetween, comprising:

a water pump secured to a front end surface of said cylinder block with an axis of rotation thereof extending through a central portion of a front end surface of said cylinder block;

a fan disposed coaxially with said axis of rotation of said water pump and in front of said water pump with a front space between said fan and said front end surface of said cylinder block; and cooling water inlet means for introducing cooling water to said water pump, said cooling water inlet means having an external pipe portion extending partly in said front space toward above said water pump and partly in said V-shaped space and an internal pipe portion formed as an passageway in said cylinder block so as to interconnect said water pump and said external pipe portion.

2. A cooling apparatus as defined in claim 1, wherein said internal pipe portion is shaped as a quarter-circular passageway.

3. A cooling apparatus as defined in claim 1, and further comprising a belt by which said water pump is operationally coupled to a crankshaft of said engine and a front cover located atop said belt.

4. A cooling apparatus as defined in claim 3, wherein said front space is provided between said front cover and said fan.

5. A cooling apparatus for a V-type internal combustion engine having a cylinder block and first and second cylinder heads mounted on the cylinder block so as to provide elongated first and second cylinder banks set at an angle to each other to define a V-shaped space therebetween, comprising:

a radiator in front of said engine;

a thermostat disposed in a space provided on one side of one of said first and second cylinder heads and connected to said radiator by a cooling water pipe;

a water pump secured to a front end surface of said cylinder block with an axis of rotation extending through a central portion of a front end surface of said cylinder block;

cooling water inlet means for introducing cooling water into said water pump, said cooling water inlet means having an internal pipe portion formed as an passageway in said cylinder block with one end in communication with said water pump and its other end opening to a bottom of said V-shaped space and an external pipe portion extending in front of said front end surface of said cylinder block and turning into said V-shaped space so as to interconnect said thermostat and said other end of said internal pipe portion.

6. A cooling apparatus as defined in claim 5, wherein said internal pipe portion is shaped as a quarter-circular passageway.

* * * * *